United States Patent [19]

Black

[11] Patent Number: 4,658,893

[45] Date of Patent: Apr. 21, 1987

[54] JET PUMP WITH REVERSE FLOW REMOVAL OF INJECTION NOZZLE

[76] Inventor: John B. Black, 2115 Norman, Pasadena, Tex.

[21] Appl. No.: 863,880

[22] Filed: May 16, 1986

[51] Int. Cl.[4] ..... E21B 43/00

[52] U.S. Cl. ..... 166/68; 166/105; 417/172

[58] Field of Search ..... 166/372, 370, 383, 386, 166/68, 68.5, 69, 70, 105, 155, 156; 417/172, 178, 195, 198

[56] References Cited

U.S. PATENT DOCUMENTS

| | | | |
|---|---|---|---|
| 2,080,624 | 5/1937 | McMahon | 417/172 |
| 3,608,631 | 9/1971 | Sizer et al. | 166/70 |
| 4,293,283 | 10/1981 | Roeder | 417/172 |
| 4,504,195 | 3/1985 | Binks et al. | 417/172 |
| 4,603,735 | 8/1986 | Black | 166/68 |
| 4,605,069 | 8/1986 | McClaflin et al. | 166/310 |

*Primary Examiner*—James A. Leppink
*Assistant Examiner*—Hoang C. Dang
*Attorney, Agent, or Firm*—Warren H. Kintzinger

[57] ABSTRACT

A down the hole product flow jet pump with a reverse flow removable injection nozzle that can be in the form of an orifice member placed in a plug or a one piece orifice and plug member that is moveable up and down the pumping fluid line dependent on the direction of fluid flow and/or non-flow in the line. The jet pump includes a check valve that opens for inflow of product from the well only when a drawing vacuum is created in the jet pump vacuum chamber so normal pumping flow can be stopped and reversed with the check valve closing when pumping flow stops and remaining closed during reverse flow in the system. A trap is provided at the wellhead into which the injection nozzle is floated with reverse flow of pumping fluid in the system. The injection nozzle is removable from the trap for servicing or replacement by insertion in the trap and then, with the trap opened, permitted to float down or be pumped down to seat in the jet pump housing on location down the hole.

20 Claims, 6 Drawing Figures

JET PUMP WITH REVERSE FLOW REMOVAL OF INJECTION NOZZLE

Figure 1:
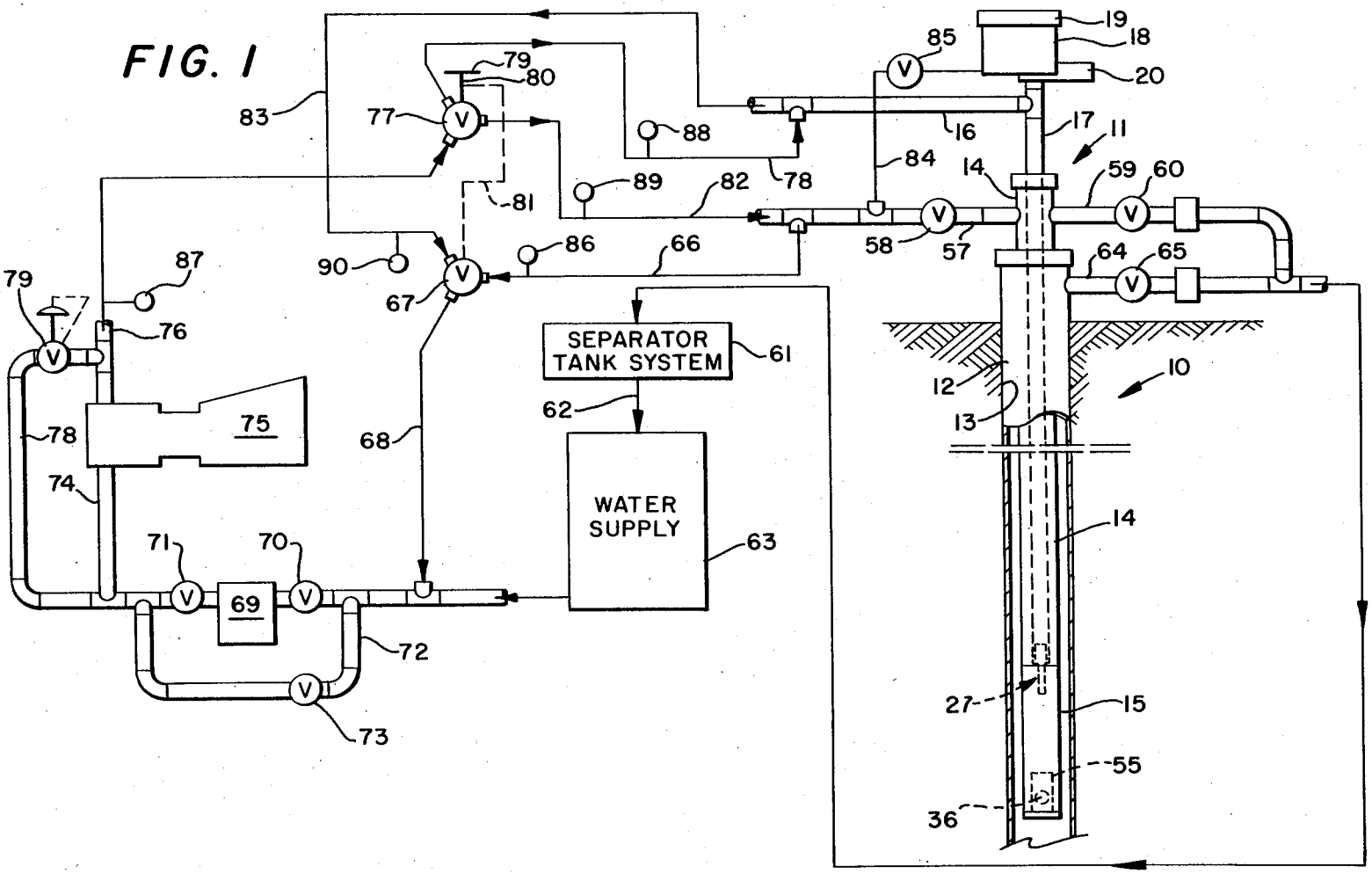

This invention relaties in general to the pumping of fluids and/or gases from wells such as oil and gas wells, and more particularly to a down the hole product jet pump with reverse flow of pumped circulation fluid floated removal of the injection nozzle for serve or replacement without removal of the pump body and fluid circulation lines from the well.

Pump jacks, sucker rod strings and down the hole reciprocating pumps of various designs have been used in the oil patch for many years. With this old tried and proven approach there are still problems such as the reflected effect on the producing formation of cyclic on-off suction with the reciprocating action of such pumps. The old tried and true pump jack is a fairly massive piece of equipment required at each well head with such a pumping system. Further, the sucker rod string extending from the pump jack down the well to the down the hole reciprocating pump is fairly expensive and must be adequately strong to avoid breakage in the well and subsequent line fishing required to recover the broken sucker rod string. Another requirement with such reciprocating pump drive sucker rod strings is that they be tuned to the pump stroke length and length of the sucker rod string consistent with the drive imparted by the pump jack. Such problems and considerations are avoided through use of applicants new improved jet pump used down the hole with a pump recirculating water system. The new system also avoids wear between relatively moving parts such as between a sucker rod string and well tubing walls and occasional failure of such members. Further, reciprocating down the hole pumps are replaced by a jet pump that generally has longer service life and does not have to be drawn up from the well serviced and replaced as often is is the case with down the hole reciprocating pumps. In fact it includes a reverse flow removable injection nozzle that can be in the form of an orifice member placed in a plug or a one piece orifice and plug member moveable up and down the pumping fluid line dependent on the direction of fluid flow in the line. Since the orifice member in a jet pump is the item most subject to wear replacement in this manner lessens even further requirement for a jet pump in its entirety being drawn up from the well for servicing. Still further, it has been shown that if a steady drawing vacuum is imposed in a well casing and on a pay zone of an oil and/or gas well during periods of pumping with lessened or eliminated well head pressure production of oil and/or gas can be significantly increased.

It is therefore a principal object of this invention to increase production of wells through use of a new pumping system using a down the hole jet pump.

Another object is to lower maintainance and operational costs through use of such a jet pump with reverse flow removal of the pump injection nozzle.

A further object with such a jet pump is to minimize service requirement imposed removal of the jet pump up from the well.

Still another object is to lower the per well hole original equipment costs in the oil patch particularly with a plurality of wells.

Another object is to avoid pressure build up in the well and, generally, to avoid introduction of circulation water into the well formation.

A further object is to reduce or eliminate head pressure in the well to optimize product flow from well formation pay zones.

Features of the invention useful in accomplishing the above objects include, in a down the hole jet pump with reverse circulation fluid flow removal of the injection nozzle useful in an oil and/or gas well pumping system, a water pump on the surface capable of supplying water flow under pressure to a jet pump down the hole of one or more than one well in a system with the separator separating oil to oil storage and circulation water to a water tank in the water circulation system and gas take off if gas is being produced from the well. The jet pump is used in a system drawing a vacuum reducing if not eliminating the effect of head pressure within the well resulting in freer fluid flow from the formation pay zone to thereby reduce costs and increase production. Water is fed downward through an innermost pipe to the jet pump body and through the jet pump body from top to bottom to a water flow reversing cap that reverses the water flow and directs the water flow back up through passages in the jet pump body toward and up larger tubing concentric with and enclosing the innermost pipe (tubing). The reverse flow removable injection nozzle is in the form of an orifice member placed in a plug or a one piece orifice and plug member that is moveable up and down the pumping fluid line dependent on the direction of fluid flow and/or non-flow in the line. The jet pump includes a check valve that opens for inflow of product from the well only when a drawing vacuum is created in the jet pump vacuum chamber so normal pumping flow can be stopped and reversed with the check valve closing when pumping flow stops and remaining closed during reverse flow in the system. A trap is provided at the wellhead into which the injection nozzle is floated with reverse flow of pumping fluid in the system. The injection nozzle is removeable from the trap for servicing or replacement by insertion in the trap and then, with the trap opened, permitted to float down or be pumped down to seat in the jet pump housing on location down the hole.

A specific embodiment representing what is presently regarded as the best mode of carrying out the invention is illustrated in the accompanying drawings.

Figure 2:
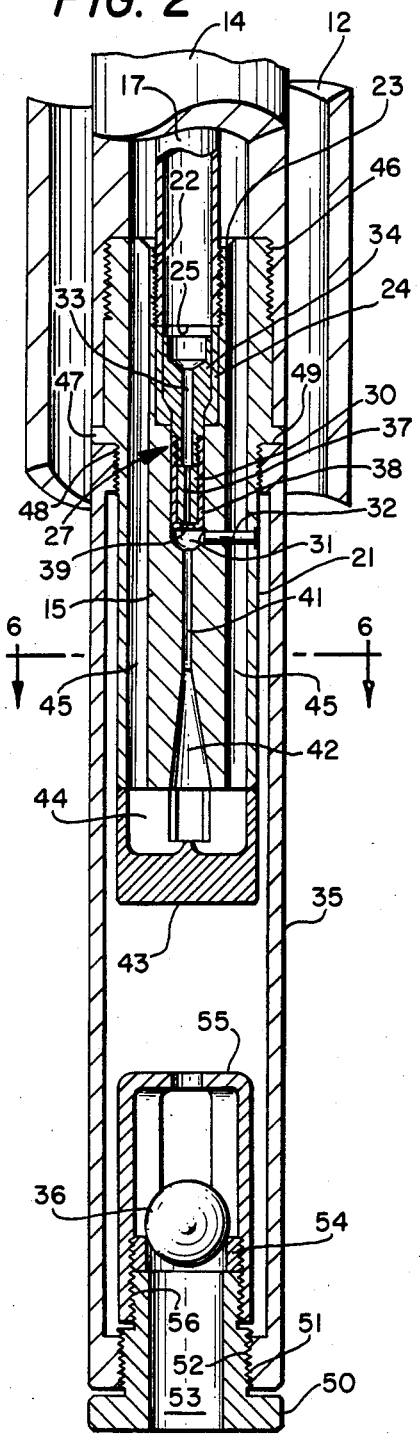
Figure 3:
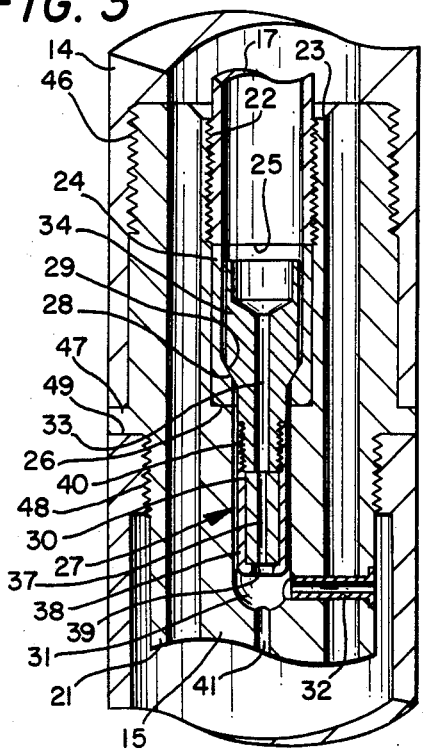
Figure 4:
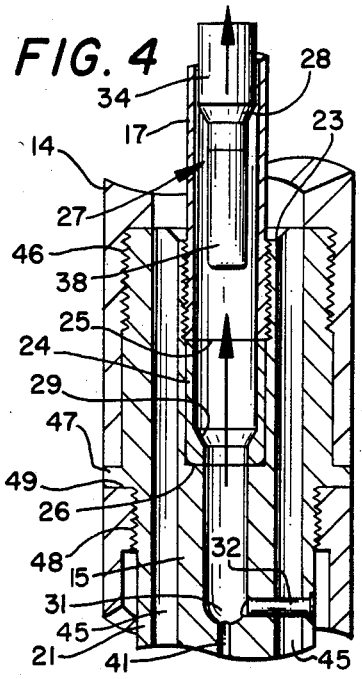
Figure 5:
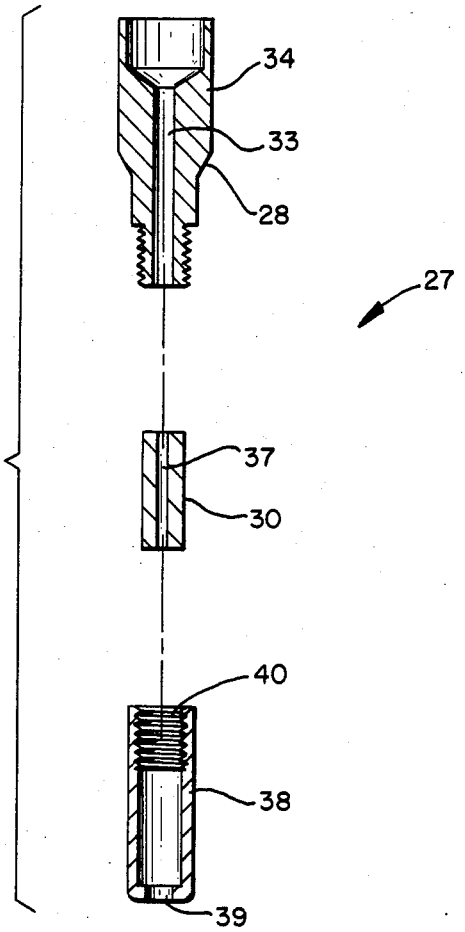
Figure 6:
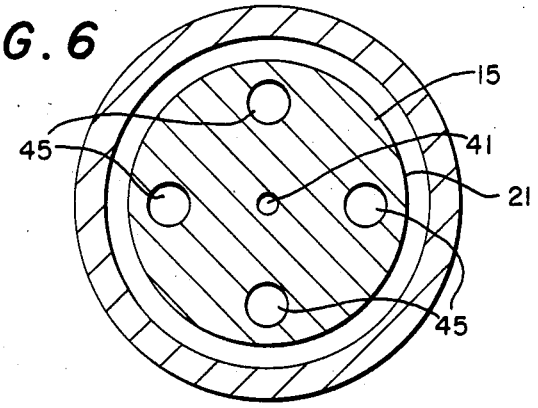

In the drawings:

FIG. 1 represents a side elevation view of an oil and/or gas well with a down the hole jet pump having a reverse flow removeable injection nozzle in place in the well;

FIG. 2, a cut away and sectioned view showing internal detail of the jet pump with connection to pipe and tubing down the hole;

FIG. 3, an enlarged cut away and sectioned view of a portion of FIG. 2 showing more injection nozzle orificae, venturi chamber and product drawing passage detail;

FIG. 4, a partially cut away and sectioned view like FIG. 3, with, however, the injection nozzle being lifted up out of the jet pump body and up the inner pipe by reverse flow of pumping fluid in the system;

FIG. 5, an exploded broken away and sectioned side elevation view of and injection nozzle assembly; and, FIG. 6, a cut away and sectioned view taken along line 6—6 of FIG. 2 showing additional detail of circulation fluid passages with the jet pump of FIG. 2.

The oil and gas well 10 of FIG. 1 is shown to extend down from a christmas tree 11 with a tubular casing 12 set in place in a drilled hole 13 in the earth. A tube 14 extends down from the christmas tree 11 to mount on its bottom a jet pump 15 as a down the hole pump. A pump circulation water pressure flow pipe 16 enters the christmas tree 11 at the side of the top of circulation water pressure flow pipe 17 just below trap container 18 that is provided with an internally threaded cap 19 and an opening and closing valve 20 at the bottom. Water pressure flow pipe 17 extends down the well casing 12 within tube 14 to the top of the jet pump 15 body 21, referring also to FIG. 2, into the top of which it is connected as by a press fit, or by threading 22, in opening 23 of the body 21.

A seat member 24 is held in the opning 23 between the bottom end 25 of pipe 17 and the bottom shoulder 26 of opening 23. The nozzle orifice plug assembly 27 when seated with its beveled shoulder 28 on the beveled seat 29 of seat member 24 supports its hardened metal nozzle member 30 in proper operational position relative to venturi chamber 31 for the desired venturi action vacuum drawing of product fluids through tube 32. This will be sufficient with the pressurized flow of circulation fluid down pipe 17 through opening 33 in nozzle orifice plug body 34 having the beveled shoulder to draw production fluids and/or gas through tube 32 from chamber enclosure 35 such as to open ball check valve 36 and draw product from the well casing 12 below jet pump 15. The circulation water then passes through opening 37 in cylindrical nozzle member 30 that is held in place at the bottom of the nozzle orifice plug assembly 27 by cap retainer 38 having an opening 39 in the bottom and threaded 40 to the bottom of nozzle orifice plug body 34 (please also refer to FIGS. 3 and 4). The circulation pumping fluids along with product fluids drawn through tube 32 pass down from venturi chamber 31 through opening 41 in jet pump body 21 and bottom conical opening 42 into jet pump bottom fluid reversing cap 43, fastened to the bottom of body 21 by conventional means not shown, where the fluid flow is redirected upward in fluid reversing chamber 44 to flow upward in openings 45, shown also in FIG. 6, that extend through jet pump body 21 from bottom to top and on upward within tube 14. The nozzle orifice plug assembly 27 may be in place in jet pump body 21 as the jet pump 15 is placed in the well with the upper end of body 21 threaded 46 into tube 14 with body shoulder 47 engaging the bottom end of tube 14. The cylindrical chamber enclosure 35 has top end internal threads 48 for the mounting of the enclosure on the jet pump body 21 with the enclosure top 49 engaging the bottom of body shoulder 47. The cylindrical chamber enclosure 35 extends down to mount at the bottom thereof ball check valve 36 with valve housing member 50 having threads 51 threaded into the bottom threads 52 of enclosure 35. Valve housing member 50 has an opening 53 from the exterior to ball seat member 54 enclosed within valve ball cap member 55 threaded 56 on valve housing member 50.

If the nozzle orifice plug assembly 27 is not initially in place in jet pump body 21 down the well it may be delivered thereto by being inserted via trap container 18 into the top of pipe 17 and then floated down the pipe with circulation water (fluid) being pumped down the pipe until it arrives in the jet pump body 21 and seats in place on beveled seat 29. Then with continued pumping of circulation fluid down pipe 17 the jet pump 15 is in operation vacuum drawing production fluids through tube 32, the chamber enclosure 35 and the ball check valve 36 from the well casing 12 below the jet pump 15.

Circulation fluid with oil and/or gas product entrained therein passes up tube 14 to the christmas tree 11 where fluids in circulation may be passed out to circulation line 57 as controlled by valve 58 and/or product line 59 through valve 60 to separator tank system 61 that returns water through line 62 to water supply tank 63. Gas and/or oil casing fluids under pressure from casing 12 may be passed through line 64 and valve 65 to separator tank system 61 when required. Circulation fluids are passed in direct flow from line 57 in line 66 to two way valve 67 and therefrom in direct flow through line 68 to and through filter 69 with valves 70 and 71 or through filter bypass line 72 with valve 73 on through line 74 to surface fluid pumping unit 75. The pumping unit 75 is output connected through line 76 to two way valve 77 and an unload line loop 78, with unload valve 79, connected from line 76 back to line 74. Pumped circulation fluid in direct flow is passed through two way valve 77 to and through line 78 and line 16 in direct flow to pipe 17 and down the pipe. When it is desired to reverse the flow of pumped circulation fluid through the pumping system of the well both valves 67 and 77 may be turned to reverse flow by turning of valve handle 79 that is connected through drive links 80 and 81 to turn both valves between direct flow and reverse flow when required. With the valves 67 and 77 turned to reverse flow circulation fluid under pressure flows from line 76 through valve 77 to and through line 82 to and through line 57 and down tube 14 to the jet pump body 21. The circulation fluid passes down through openings 45 to fluid reversing chamber 44 and up through conical opening 42 and opening 41 to venturi chamber 31 to exert fluid lifting pressure from the bottom on nozzle orifice plug assembly 27 sufficient to lift it from its otherwise seated state in the jet pump body 21 and float it up the pipe 17 to the surface and into trap 18. The nozzle orifice plug assembly 27 can be removed from trap 18 for servicing or replacement with a nozzle orifice plug assembly 27 then being, with direct fluid circulation flow, floated back down to be reseated in the jet pump body down the well. Whenever circulation fluid is not being pumped static fluid pressure keeps ball check valve 36 closed, and when circulation fluid is being pumped through the system in reverse fluid pressure from venturi chamber 31 exerted through tube 32 and chamber 35 also keeps ball check valve 36 closed. The circulation fluid in reverse flow passes from pipe 17 through line pipe 16 and on through line 83 to and through valve 67 and line 68 in reverse circulation back to the surface pump unit 75.

A bleed line 84 with valve 85 runs from trap 18 to lines 57, 66 and 82. Fluid pressure gauges 86, 87, 88, 89 and 90 are provided on fluid lines 66, 76, 78, 82 and 83, respectively, as a convenient check of fluid pressure in the lines.

Whereas this invention has been described with respect to a single embodiment thereof, it should be realized that various changes may be made without departure from the essential contributions to the art made by the teachings hereof.

I claim:

1. A down the hole product flow jet pump in a system operational with circulation fluids pumped from above the earth surface comprising: an in the well down the hole jet pump; first down flow fluid passage means connected to said jet pump and extending up the hole to the well head at the surface; first up flow fluid passage means connected to said jet pump and extending up the hole to the well head at the surface; a jet pump body with second down flow fluid passage means connected to and forming an extension of said first down flow fluid passage means connected to and forming an extension of said first down flow fluid passage means; removeable injection nozzle means that seats in said jet pump body; seat means in said jet pump body for holding said removeable injection nozzle means; a jet pump venturi chamber in said jet pump body positioned for vacuum drawing of product from the well when circulation fluid flows down through said removeable injection nozzle means; additional fluid passage means from said venturi chamber to the well including one way fluid flow means; fluid flow reversing means mounted on the bottom of said jet pump body; lower opening means in said jet pump body extending from said venturi chamber to said fluid flow reversing means; second up flow fluid passage means extending through said jet pump body from said fluid flow reversing means to the top of said body and connected to said first up flow passage means; circulation fluid pumping means at the surface; surface fluid passage means including fluid flow reversing valve means interconnecting said circulation fluid pumping means, said first down flow fluid passage means and said first up flow fluid passage means for pumping production fluids from the well and for pumping fluid in reverse through the system for float removal of said injection nozzle means from said seat means in said body, for movement up from said jet pump body and on up said first down flow fluid passage means to the well head; and injection nozzle removal means connected to said first down flow fluid passage means at the well head.

2. The jet pump with circulation fluid reverse flow injection nozzle removal of claim 1, wherein said injection nozzle removal means is a trap container into which said removable injection nozzle means is floated with reverse flow of pumping fluid in the system.

3. The jet pump with circulation fluid reverse flow injection nozzle removal of claim 2, wherein said one way fluid flow means opens for production fluid and/or gas flow from the well to said venturi chamber when circulation fluid is being pumped down through said first down flow fluid passage means and through said removeable injection nozzle means seated in said seat means in said jet pump body.

4. The jet pump with circulation fluid reverse flow injection nozzle removal of claim 3, wherein said one way fluid flow means closes from fluid through flow when circulation fluid is pumped in reverse through the jet pump fluid circulation system.

5. The jet pump with circulation fluid reverse flow injection nozzle removal of claim 4, wherein said one way fluid flow means is a check valve positioned in said fluid passage means from said venturi chamber to the well.

6. The jet pump with circulation fluid reverse flow injection nozzle removal of claim 5, wherein said check valve is a ball check valve mounted in the lower end of a cylindrical housing, which is mounted at the top to said jet pump body; and passage means extended from said venturi chamber through said jet pump body to the interior of said cylindrical housing.

7. The jet pump with circulation fluid reverse flow injection nozzle removal of claim 3, wherein said first down flow fluid passage means is a tubular fluid conduit with an internal diameter sufficient to permit passage therethrough of said removeable injection nozzle means.

8. The jet pump with circulation fluid reverse flow injection nozzle removal of claim 7, wherein an opening and closing trap valve is located at the bottom of said trap container that permits passage of said removeable injection nozzle from said first down flow passage means to the interior of said trap container when said trap valve is open.

9. The jet pump with circulation fluid reverse flow injection nozzle removal of claim 8 wherein said trap container is provided with opening means that permits removal of an injection nozzle from the trap container and reinsertion of an injection nozzle into said trap container for the floating down of an injection nozzle from the trap container to the jet pump body down the well.

10. The jet pump with circulation fluid reverse flow injection nozzle removal of claim 3, wherein said fluid flow reversing valve means includes a first valve having one input port and two output ports and valve control means for selecting one or the other of said two output ports; a second valve having one output port and two input ports, and valve control means for selecting one or the other of said two input ports; and said fluid passage means including fluid flow reversing valve means includes fluid flow line means from the output port of said second valve extending to the input of said circulation fluid pumping means, and output fluid flow line means from the output of said circulation fluid pumping means extending to the input port of said first valve.

11. The jet pump with circulation fluid reverse flow injection nozzle removal of claim 10, wherein one of the output ports of said first valve is fluid flow line connected to said first down flow fluid passage means, and the other output port of said first valve is fluid flow line connected to said first up flow fluid passage means; and wherein one of the input ports of said second valve is fluid flow line connected to said first up flow fluid passage means, and the other input port of said second valve is fluid flow line connected to said first down flow fluid passage means.

12. The jet pump with circulation fluid reverse flow injection nozzle removal of claim 11, wherein said valve control means of said first valve, and said valve control means of said second valve are drive interconnected so that both said first and second valves are simultaneously thrown from one port to the other for controlled reversing of the flow of jet pump circulation pumping fluid through the fluid circulation system.

13. The jet pump with circulation fluid reverse flow injection nozzle removal of claim 4, wherein said removeable injection nozzle means has an enlarged upper cylindrical body portion and a lower cylindrical body portion smaller than said upper body portion extending down from said upper body portion; and an annular shoulder forming the transition from said upper cylindrical body portion to said lower cylindrical body portion.

14. The jet pump with circulation fluid reverse flow injection nozzle removal of claim 13, wherein said annular shoulder is in the form of a truncated cone in the transition from said upper cylindrical body portion to said lower cylindrical body portion.

15. The jet pump with circulation fluid reverse flow injection nozzle removal of claim 14, wherein said seat means in said jet pump body is in the form of a truncated cone acting as a seat for the truncated cone of said removeable injection nozzle means; and said lower cylindrical body portion extending down to said jet pump venturi chamber when said removeable injection nozzle means is seated in said jet pump body.

16. The jet pump with circulation fluid reverse flow injection nozzle removal of claim 15, wherein fluid passage opening means is provided through said removeable injection nozzle from top to bottom thereof.

17. The jet pump with circulation fluid reverse flow injection nozzle removal of claim 15, wherein an opening is provided in said jet pump body extending from said seat means in said jet pump body to said jet pump venturi chamber with the bottom end of said lower cylindrical body portion extended into said opening in said jet pump body defining the top of said venturi chamber when said removeable injection nozzle means is seated in said jet pump body.

18. The jet pump with circulation fluid reverse flow injection nozzle removal of claim 17, wherein said removeable injection nozzle means is formed with an upper nozzle orifice plug body having an annular beveled shoulder in the form of a truncated cone seating shoulder, a cap retainer mounted on the bottom of said upper nozzle orifice plug body, and a hardened metal nozzle member enclosed within said cap retainer.

19. The jet pump with circulation fluid reverse flow injection nozzle removal of claim 18, wherein an upper opening is provided in said jet pump body and said seat means in said jet pump body is a part of a cylindrical seat member held in said upper opening.

20. The jet pump with circulation fluid reverse flow injection nozzle removal of claim 19, wherein said first up flow fluid passage means is in the form of a tube generally concentric with said first down flow passage means.

* * * * *